US009302320B2

(12) United States Patent
Waniuk et al.

(10) Patent No.: US 9,302,320 B2
(45) Date of Patent: Apr. 5, 2016

(54) MELT-CONTAINMENT PLUNGER TIP FOR HORIZONTAL METAL DIE CASTING

(71) Applicants: Apple Inc., Cupertino, CA (US); Crucible Intellectual Property, LLC, Rancho Santa Margarita, CA (US)

(72) Inventors: Theodore A. Waniuk, Lake Forest, CA (US); Joseph Stevick, Olympia, WA (US); Sean O'Keeffe, Tustin, CA (US); Dermot J. Stratton, San Francisco, CA (US); Joseph C. Poole, San Francisco, CA (US); Matthew S. Scott, San Jose, CA (US); Christopher D. Prest, San Francisco, CA (US)

(73) Assignees: Apple Inc., Cupertino, CA (US); Crucible Intellectual Property, LLC, Ranco Santa Margarita, CA (US)

( * ) Notice: Subject to any disclaimer, the term of this patent is extended or adjusted under 35 U.S.C. 154(b) by 0 days.

(21) Appl. No.: 14/467,478

(22) Filed: Aug. 25, 2014

(65) Prior Publication Data

US 2014/0360695 A1 Dec. 11, 2014

Related U.S. Application Data

(60) Division of application No. 13/630,900, filed on Sep. 28, 2012, now Pat. No. 8,813,818, which is a continuation-in-part of application No. PCT/US2011/060382, filed on Nov. 11, 2011.

(51) Int. Cl.
*B22D 17/08* (2006.01)
*B22D 17/10* (2006.01)
(Continued)

(52) U.S. Cl.
CPC ..... *B22D 17/2053* (2013.01); *B22D 17/007* (2013.01); *B22D 17/04* (2013.01);
(Continued)

(58) Field of Classification Search
CPC ..... B22D 17/2053; B29C 45/535
USPC ..... 164/80, 113, 120, 303, 312, 313
See application file for complete search history.

(56) References Cited

U.S. PATENT DOCUMENTS 2,657,429 A 11/1953 Faust
3,731,727 A 5/1973 Mitamura et al.
(Continued)

FOREIGN PATENT DOCUMENTS

EP 0845316 6/1998
EP 1013363 6/2000
(Continued)

OTHER PUBLICATIONS

Inoue et al., "Bulk amorphous alloys with high mechanical strength and good soft magnetic properties in Fe—Tm—B(Tm=IV-VIII group transition metal) system", Appl. Phys. Lett., vol. 71, p. 464 (1997).
(Continued)

*Primary Examiner* — Kevin E Yoon
(74) *Attorney, Agent, or Firm* — Brownstein Hyatt Farber Schreck, LLP

(57) ABSTRACT

Various embodiments provide apparatus and methods for injection molding. In one embodiment, a constraining plunger may be configured in-line with an injection plunger to transfer a molten material from a melt zone and into a mold. The constraining and injection plungers are configured to constrain the molten material there-between while moving. The constrained molten material can be controlled to have an optimum surface area to volume ratio to provide minimized heat loss during the injection molding process. The system can be configured in a longitudinal direction (e.g., horizontally) for movement between the melt zone and mold along a longitudinal axis. A molded bulk amorphous object can be ejected from the mold.

24 Claims, 9 Drawing Sheets

(51) Int. Cl.

| | |
|---|---|
| ***B22D 17/20*** | (2006.01) |
| ***B22D 17/00*** | (2006.01) |
| ***B22D 17/04*** | (2006.01) |
| ***B22D 17/14*** | (2006.01) |
| ***B22D 17/22*** | (2006.01) |
| ***B22D 17/32*** | (2006.01) |
| ***B22D 25/06*** | (2006.01) |
| ***B22D 27/15*** | (2006.01) |

(52) U.S. Cl.

CPC ..... *B22D 17/14* (2013.01); *B22D 17/203* (2013.01); *B22D 17/2038* (2013.01); *B22D 17/2069* (2013.01); *B22D 17/2236* (2013.01); *B22D 17/32* (2013.01); *B22D 25/06* (2013.01); *B22D 27/15* (2013.01)

(56) References Cited

U.S. PATENT DOCUMENTS

| | | | | |
|---|---|---|---|---|
| 3,736,844 | A | 6/1973 | Jahnke | |
| 4,601,321 | A | 7/1986 | Tokui et al. | |
| 4,623,015 | A | 11/1986 | Zecman | |
| 5,288,344 | A | 2/1994 | Peker et al. | |
| 5,368,659 | A | 11/1994 | Peker et al. | |
| 5,515,905 | A | 5/1996 | Lester | |
| 5,618,359 | A | 4/1997 | Lin et al. | |
| 5,711,363 | A | 1/1998 | Scruggs et al. | |
| 5,735,975 | A | 4/1998 | Lin et al. | |
| 5,896,642 | A | 4/1999 | Peker et al. | |
| 6,021,840 | A | 2/2000 | Colvin | |
| 6,189,600 | B1 | 2/2001 | Taniguchi et al. | |
| 6,267,170 | B1 | 7/2001 | Onuki et al. | |
| 6,267,171 | B1 | 7/2001 | Onuki et al. | |
| 6,283,197 | B1 | 9/2001 | Kono | |
| 6,325,868 | B1 | 12/2001 | Kim et al. | |
| 6,371,195 | B1 | 4/2002 | Onuki et al. | |
| 6,427,753 | B1 | 8/2002 | Inoue et al. | |
| 6,875,293 | B2 | 4/2005 | Peker | |
| 7,017,645 | B2 | 3/2006 | Johnson et al. | |
| 7,488,170 | B2 | 2/2009 | Yuasa et al. | |
| 7,575,040 | B2 | 8/2009 | Johnson | |
| 7,708,844 | B2 | 5/2010 | Muramatsu et al. | |
| 7,784,525 | B1 | 8/2010 | Dai | |
| 7,906,219 | B2 | 3/2011 | Ohara et al. | |
| 2002/0005233 | A1 | 1/2002 | Schirra et al. | |
| 2004/0055727 | A1 * | 3/2004 | Hong | B22D 1/00 164/113 |
| 2005/0028961 | A1 | 2/2005 | Toyoshima et al. | |
| 2005/0242454 | A1 | 11/2005 | Yuasa et al. | |
| 2006/0254747 | A1 | 11/2006 | Ishida et al. | |
| 2007/0079907 | A1 | 4/2007 | Johnson et al. | |
| 2008/0135136 | A1 | 6/2008 | Demetriou et al. | |
| 2008/0305387 | A1 | 12/2008 | Murray et al. | |
| 2009/0162629 | A1 | 6/2009 | Demetriou et al. | |
| 2009/0236494 | A1 | 9/2009 | Hata et al. | |
| 2009/0321037 | A1 | 12/2009 | Lewis et al. | |
| 2010/0084052 | A1 | 4/2010 | Farmer et al. | |
| 2010/0230012 | A1 | 9/2010 | Demetriou et al. | |
| 2010/0300148 | A1 | 12/2010 | Demetriou et al. | |
| 2011/0079940 | A1 | 4/2011 | Schroers et al. | |
| 2011/0108231 | A1 | 5/2011 | Zheng et al. | |

FOREIGN PATENT DOCUMENTS

| | | |
|---|---|---|
| FR | 2665654 | 2/1992 |
| JP | 55036033 | 3/1980 |
| JP | 59-87963 | 5/1984 |
| JP | 2229660 | 9/1990 |
| JP | 3-275263 | 12/1991 |
| JP | 6212205 | 8/1994 |
| JP | 9-24454 | 1/1997 |
| JP | 9272929 | 10/1997 |
| JP | 9-323146 | 12/1997 |
| JP | 2000024767 | 1/2000 |
| JP | 2000117411 | 4/2000 |
| JP | 2000326065 | 11/2000 |
| JP | 2001-150496 | 6/2001 |
| JP | 2001303218 | 10/2001 |
| JP | 2002224812 A * | 8/2002 |
| JP | 2004050269 | 2/2004 |
| JP | 2006289466 | 10/2006 |
| JP | 2010036210 | 2/2010 |
| WO | WO0037201 | 6/2000 |
| WO | WO2008046219 | 4/2008 |
| WO | WO2009067512 | 5/2009 |

OTHER PUBLICATIONS

Shen et al., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

International Search Report issued in PCT/US2011/060382, mailed Jul. 19, 2012.

Kargahi et al., "Analysis of failure of conducting crucible used in induction metal", Aug. 1988.

McDeavitt et al., "High Temperature Interaction Behavior at Liquid Metal-Ceramic Interfaces", Journal of Materials Engineering and Performance, vol. 11, Aug. 2002.

Inoue et al., "Microstructure and Properties of Bulky AlNiCe Alloys with Amorphous Surface Layer Prepared by High-Pressure Die Casting", Materials Transactions, JIM, vol. 35, No. 11 (1994), pp. 808-813.

Japanese Patent Office Notice of Reasons for Rejection, Japanese Patent Application No. 2014-541023, mail date Oct. 14, 2014.

* cited by examiner

MELT-CONTAINMENT PLUNGER TIP FOR HORIZONTAL METAL DIE CASTING

CROSS REFERENCE TO RELATED APPLICATION

This application is a division of U.S. application Ser. No. 13/630,900, filed on Sep. 28, 2012, which will issue as U.S. Pat. No. 8,813,818 on Aug. 26, 2014, which is a continuation-in-part of and claims priority to PCT Application No. PCT/US2011/060382, filed Nov. 11, 2011. The disclosure of the prior application is considered part of and is incorporated by reference in the disclosure of this application.

FIELD

The present disclosure is generally related to apparatus and methods for injection molding and, more particularly, related to apparatus and methods for injection molding using a constraining plunger.

BACKGROUND

Some conventional casting or molding machines include a single plunger that moves and packs the molten alloy through a transfer sleeve into a mold using increased force with unconstrained flow. This unconstrained flow has high surface area to volume ratio and thus a high heat transfer rate. As a result, the molten alloy loses heat to the machine components when transferred and/or injected into the mold.

When molding or casting a high aspect ratio part using amorphous alloys in some conventional systems, the molded part tends to be non-uniform and/or crystallized because the quenching rate of the mold is insufficient (e.g., the material cools too quickly on one side, and does not cool quickly enough on other side(s) (e.g., plunger side)). Increasing the speed or force of the single plunger rod does not reduce this problem.

Additionally, in horizontal injection systems, the molten material has to be retained in the melt zone so that it does not mix too much or cool too quickly.

SUMMARY

A proposed solution according to embodiments herein for improving molded objects is to use bulk-solidifying amorphous alloys. In addition to using an injection plunger, a constraining plunger is proposed to constrain the molten material during melting and/or transferring of the molten material. The constrained molten material may provide an optimum surface area to volume ratio having a minimized heat loss during the injection molding process.

In accordance with various embodiments, there is provided an injection molding apparatus. The apparatus can include, for example, a mold for molding a molten material, an injection plunger, and a constraining plunger configured movable through at least a portion of the mold. The constraining plunger can be configured in-line with the injection plunger to constrain the molten material there-between, when moving the molten material into the mold.

In accordance with various embodiments, there is provided a method. In this method, a mold can be connected with a melt zone via a transfer sleeve such that a molten material is able to be transferred from the melt zone, through the transfer sleeve, and into the mold at least by an injection plunger. A constraining plunger can be configured movable through at least a portion of the mold and in-line with the injection plunger to constrain the molten material there-between to move the molten material into the mold.

In accordance with various embodiments, there is provided a method. In this method, an apparatus can be obtained including a mold, a melt zone, an injection plunger, and a constraining plunger configured movable through at least a portion of the mold and in-line with the injection plunger. An alloy feedstock can be melted in the melt zone to provide a molten material, which can then be moved or transferred from the melt zone into the mold through the transfer sleeve. When moving towards the mold through the transfer sleeve, the molten material can be controllably constrained between the constraining plunger and the injection plunger.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
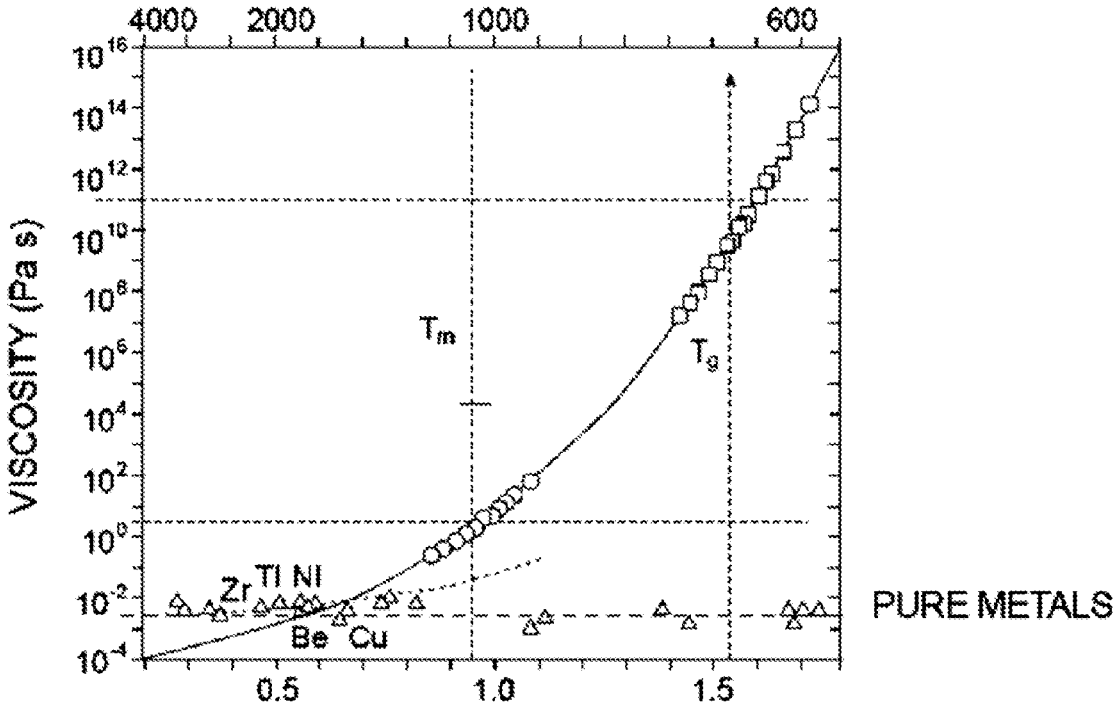
FIG. 1 PRIOR ART
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
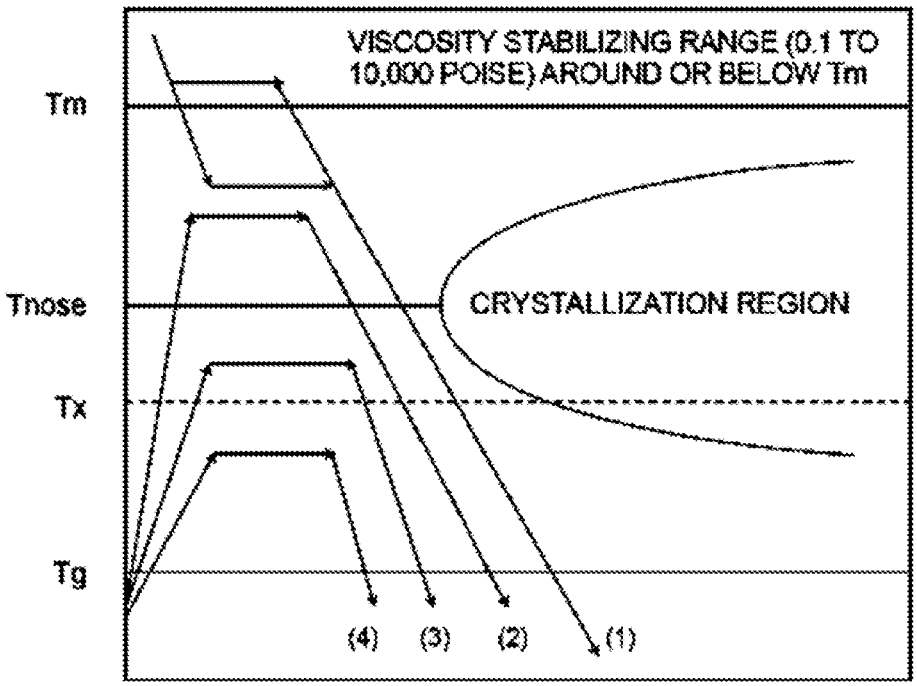
FIG. 2 PRIOR ART
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^5$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can include multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can include a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can include multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function:

$$G(x,x')=\langle s(x),s(x')\rangle.$$

In the above function, s is the spin quantum number and x is the distance function within the particular system. This function is equal to unity when x=x' and decreases as the distance |x−x'| increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically includes a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can include the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the afore-described alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0305387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo-(Y,Ln)-C—B, Co—Cr-Mo-Ln-C—B, Fe—Mn—Cr-Mo-(Y,Ln)-C—B, (Fe, Cr, Co)-(Mo,Mn)—(C,B)—Y, Fe—(Co,Ni)—(Zr,Nb,Ta)-(Mo,W)—B, Fe—(Al,Ga)—(P,C,B, Si,Ge), Fe—(Co,Cr,Mo,Ga,Sb)—P—B—C, (Fe, Co)—B—Si—Nb alloys, and Fe—(Cr—Mo)-(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Cu4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

By way of review, the inventors have observed that it is desirable to provide the molten material with a temperature above a critical high temperature before being injected into a tool cavity (e.g., a mold cavity such as a die cavity), and to reduce/avoid heat loss during injection of the molten material through a transfer sleeve. Providing the molten material above the critical high temperature can avoid premature solidification of the molten material and/or can allow the molten material to experience rapid cooling when it is in the tool (e.g., a mold) such that the molded objects can be formed substantially in an amorphous state, i.e., without forming crystals.

Existing casting or molding machines provide unconstrained flow of the molten material during its transfer and/or injection into the mold. For example, when the alloy is melted and poured into the shot sleeve, the molten material may be spilled out all around having a geometry or shape that allows it to loose heat very quickly due to high surface area to volume ratio of the molten material, which facilitates a high heat transfer rate to adjacent machine components and/or environment. For this reason, the molten alloy must remain above a critical temperature before being injected into a tool cavity. For example, the foreign material (such as the molten material) may have a temperature of around 1,050 degrees Celsius or higher before injection.

With this said, the disclosed embodiments are directed to apparatus and/or methods to at least control the unconstrained flow during transfer and injection of the molten material. In embodiments, parts of the apparatus (or access thereto) can be positioned in-line with each other, for example, they can be aligned and/or operated on a horizontal (or vertical) axis. In an example, the mold parts of a mold can be opened horizontally (or vertically).

In one embodiment, the apparatus can include a constraining plunger configured within or through one mold part, while the other mold part is connected to a transfer sleeve such that an injection plunger can inject molten materials through the transfer sleeve into the mold cavity formed by the two mold parts. The constraining plunger may be used to transfer an alloy feedstock, which is muzzle loaded into the transfer sleeve for example, through the transfer sleeve into a melt vessel to melt the alloy feedstock therein to form molten material. The constraining plunger and the injection plunger may then be synchronized to transfer the molten material, for example, by synchronous movement of the constraining plunger and the injection plunger, through the transfer sleeve. When the constraining plunger reaches its hard stop mechanism provided by the mold part, the injection plunger continues injecting the molten material, e.g., by applying pressure, until the molten material fills the mold cavity formed between the mold parts. The molten material can then be solidified at a desired cooling rate to form BMG objects, for example, which can then be ejected from the mold cavity.

In some embodiments, exemplary apparatus can be a casting or molding apparatus that does not include a pour hole as seen in conventional transfer sleeves to pour molten material from a heated crucible into the transfer sleeve. In other embodiments, exemplary apparatus can be a casting or molding apparatus that may or may not include a constraining gate configured between the mold and the transfer sleeve due to use of the constraining plunger. In yet other embodiments, exemplary apparatus can allow alloy feedstock in a solid state to be fed into the transfer sleeve from a direction opposite to the injection due to use of the constraining plunger.

The following embodiments are for illustrative purposes only and are not meant to be limiting.

As disclosed herein, a system (or a device or a machine) is configured to perform injection molding of material(s) (such as amorphous alloys). The system is configured to process such materials or alloys by melting at higher melting temperatures before injecting the molten material into a mold for molding. As further described below, parts of the system are positioned in-line with each other. In accordance with some embodiments, parts of the system (or access thereto) are aligned on a horizontal axis.

Figure 3:
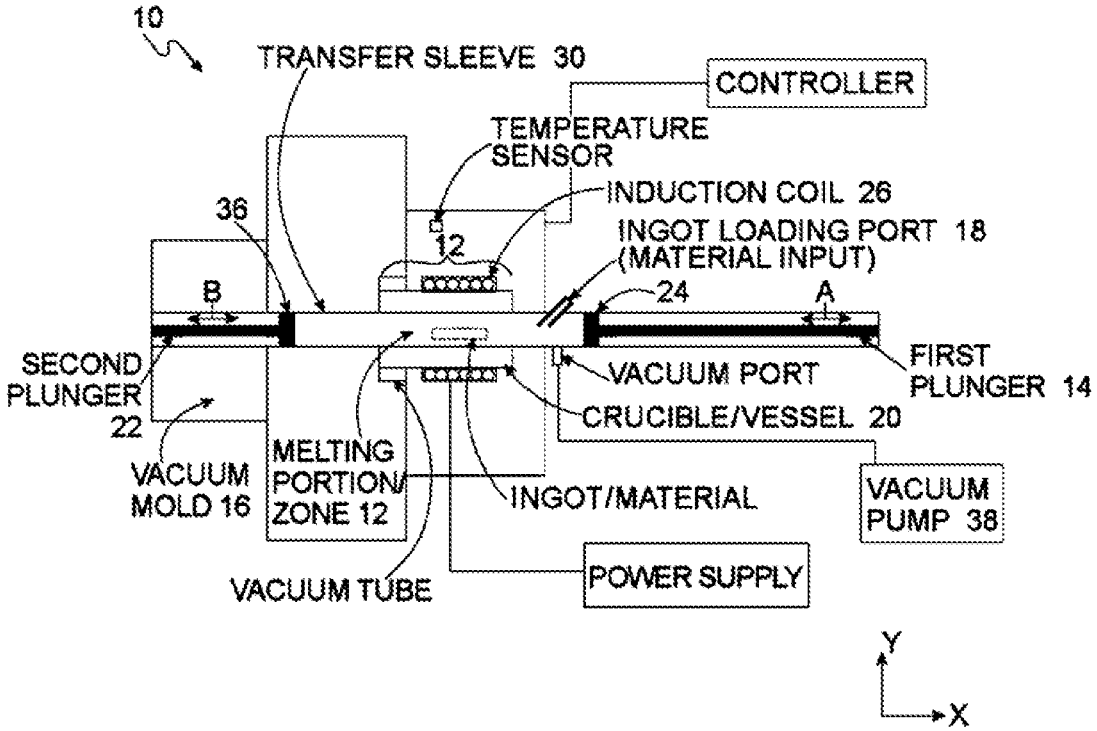
FIG. 3 illustrates an injection molding system with a dual plunger rod assembly in accordance with an embodiment of the disclosure.

FIG. 3 illustrates a schematic diagram of such an exemplary system. Although the system illustrated in the Figures is a system aligned along a horizontal axis, it should be understood and within the scope of this disclosure that similar features may be provided on a vertically positioned injection molding system (e.g., wherein there is vertical movement of material into a mold), and that herein disclosed features can be applied to a vertical system.

As shown, horizontal injection molding system 10 has a melt zone 12 configured to melt meltable material received therein, and a dual plunger rod assembly configured to transport molten material from the melt zone 12 and into a mold 16. The dual plunger rod assembly includes a first plunger rod 14 and a second plunger rod 22. At least the first plunger rod 14 is configured to move, transport, transfer and/or eject molten material from melt zone 12 and into a mold 16. In an embodiment, the first and second plunger rods 14 and 22 are configured to transport molten material from melt zone 12 and into mold 16. The first plunger rod 14 and the second plunger rod 22 are configured to move along a same axis. Among other things, the first and second plungers rods are configured to contain molten material (e.g., melted in melt zone 12) therebetween during movement of the molten material into mold 16. The first plunger rod 14 and the second plunger rod 22 have movable rods with plunger tips 24 and 36, respectively, that are configured to contact and transport material. Further description regarding features of the dual plunger rod assembly is detailed below with reference to FIGS. 4-8. In one embodiment, the dual plunger rod assembly and melt zone 12 are provided in-line and on a horizontal axis (e.g., X axis), such that plunger rods 14 and 22 are moved in a horizontal direction (e.g., along the X-axis).

The meltable material can be received in the melt zone in any number of forms. For example, the meltable material may be provided into melt zone 12 in the form of an ingot (solid state), a semi-solid state, a slurry that is preheated, powder, pellets, etc. In some embodiments, a loading port (such as the illustrated example of an ingot loading port 18) may be provided as part of injection molding system 10. Loading port 18 can be a separate opening or area that is provided within the machine at any number of places. In an embodiment, loading port 18 may be a pathway through one or more parts of the machine. For example, the material (e.g., ingot) may be inserted in a horizontal direction into vessel 20 by plunger 14, or may be inserted in a horizontal direction from the mold side of the injection system 10 by plunger 22 (e.g., through mold 16 and/or through an optional transfer sleeve 30 and into vessel 20). In other embodiments, the meltable material can be provided into melt zone 12 in other manners and/or using other devices (e.g., through an opposite end of the injection system).

Melt zone 12 includes a melting mechanism configured to receive meltable material and to hold the material as it is heated to a molten state. The melting mechanism may be in the form of a vessel 20, for example, that has a body for receiving meltable material and configured to melt the material therein. A vessel as used throughout this disclosure is a container made of a material employed for heating substances to high temperatures. For example, in an embodiment, the vessel may be a crucible, such as a boat style crucible, or a skull crucible. In an embodiment, vessel 20 is a cold hearth melting device that is configured to be utilized for meltable material(s) while under a vacuum (e.g., applied by a vacuum device 38 or pump). In one embodiment, the vessel is a temperature regulated vessel.

Vessel 20 may have an inlet for inputting material (e.g., feedstock) into a receiving or melting portion of its body. Vessel 20 can comprise any number of shapes or configurations. Vessel 20 may receive material (e.g., in the form of an ingot) in its melting portion using one or more devices of an injection system for delivery (e.g., loading port and/or plunger(s)). The body of the vessel has a length and can extend in a longitudinal and horizontal direction, such that molten material is removed horizontally therefrom using plunger 14 and/or plunger 22. Its body may be formed from any number of materials (e.g., copper, silver), include one or more coatings, and/or configurations or designs. The body of vessel 20 may be configured to receive at least plunger rod 14 therein and therethrough in a horizontal direction to move the molten material. In an embodiment, both first plunger rod 14 and second plunger rod 22 and/or at least their tips 24 and 36, respectively, are configured to be positioned in or adjacent the body of the vessel (e.g., when melting material). That is, in an embodiment, the melting mechanism is on the same axis as the plunger rods 14 and 22, and the body can be configured and/or sized to receive at least part of the plunger rods 14 and 22. Thus, at least plunger rod 14 can be configured to move molten material (after heating/melting) from the vessel by moving substantially through vessel 20, and into mold 16 (e.g., as shown and described with reference to FIGS. 5-6).

To heat melt zone 12 and melt the meltable material received in vessel 20, injection system 10 includes a heat source that is used to heat and melt the meltable material. At least a melting portion of the vessel, if not substantially the entire body itself, is configured to be heated such that the material received therein is melted. Heating is accomplished using, for example, an induction source 26 positioned within melt zone 12 that is configured to melt the meltable material. In an embodiment, induction source 26 is positioned adjacent vessel 20. For example, induction source 26 may be in the form of a coil positioned in a helical pattern substantially around a length of the vessel body. Accordingly, vessel 20 is configured to inductively melt a meltable material (e.g., an inserted ingot) within its melting portion by supplying power to induction source/coil 26, using a power supply or source 28. Induction coil 26 is configured to heat up and melt any material that is contained by vessel 20 without melting and wetting vessel 20. Induction coil 26 emits radiofrequency (RF) waves towards vessel 20. As shown, coil 26 surrounding vessel 20 may be configured to be positioned in a horizontal direction along a horizontal axis (e.g., X axis).

In one embodiment, the vessel 20 is a temperature regulated vessel. Such a vessel may include one or more temperature regulating lines configured to flow a liquid (e.g., water, or other fluid) therein for regulating a temperature of the material received in the vessel (e.g., to force cool the vessel). Such a forced-cool crucible can also be provided on the same axis as the plunger rod. The cooling line(s) assist in preventing excessive heating and melting of the body of the vessel 20 itself. In an embodiment, either or both first and second plunger rods 14 and 22 may include temperature regulating lines. For example, lines may be provided in each of the rods and into tips 24 and 36 of the plunger rods 14 and 22 (not shown). Such an addition of cooling liquid may assist in keeping plunger tips 24 and 36 cool while transporting material, preventing excessive heating and/or melting of the tips, for example. In an embodiment, both of the plunger rods are water cooled (or forced cooled) to act as a quenching mechanism. In one embodiment, both plungers may be provided at or cooled to a similar temperature. In another embodiment, one plunger (and/or its tip) may have a higher temperature than the other plunger (and/or its tip). In another embodiment, one plunger (and/or its tip) may be at a temperature higher than Tg of the material/alloy. In yet another embodiment, one plunger may be at a temperature within the super cooled region of the casting alloy.

Any of the herein cooling line(s) may be connected to a cooling system (not shown) configured to induce flow of a liquid in the vessel. The cooling line(s) may include one or more inlets and outlets for the liquid or fluid to flow therethrough. The inlets and outlets of the cooling lines may be configured in any number of ways and are not meant to be limited. The number, positioning and/or direction of the cooling line(s) should not be limited. The cooling liquid or fluid may be configured to flow through the cooling line(s) during melting of the meltable material in the melt zone 12, when induction source 26 is powered, and/or during transport of the molten material from the melt zone 12.

As previously noted, systems such as injection molding system 10 that are used to mold materials such as metals or alloys may implement a vacuum when forcing molten material into a mold or die cavity. Injection molding system 10 can further includes at least one vacuum source 38 or pump that is configured to apply vacuum pressure to at least melt zone 12 and mold 16. The vacuum pressure may be applied to at least the parts of the injection molding system 10 used to melt, move or transfer, and mold the material therein. For example, the vessel 20, a transfer sleeve 30 (described below), and dual plunger rod assembly may all be under vacuum pressure and/or enclosed in a vacuum chamber during the melting and injection process.

Figure 6:
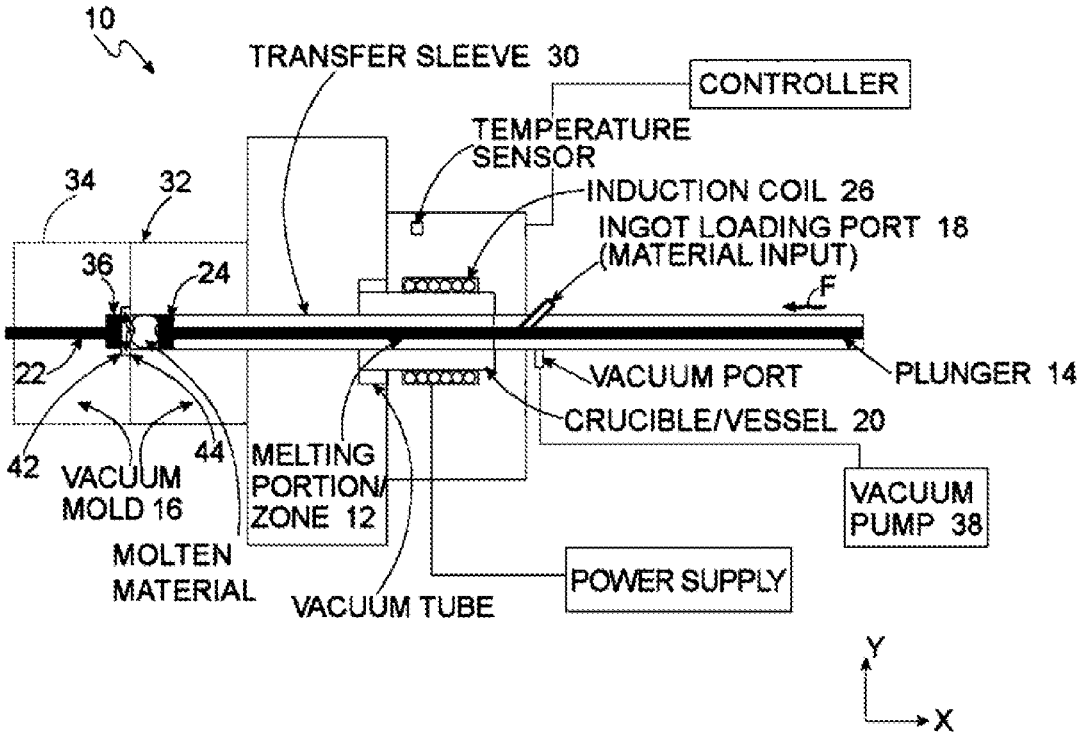
Figure 7:
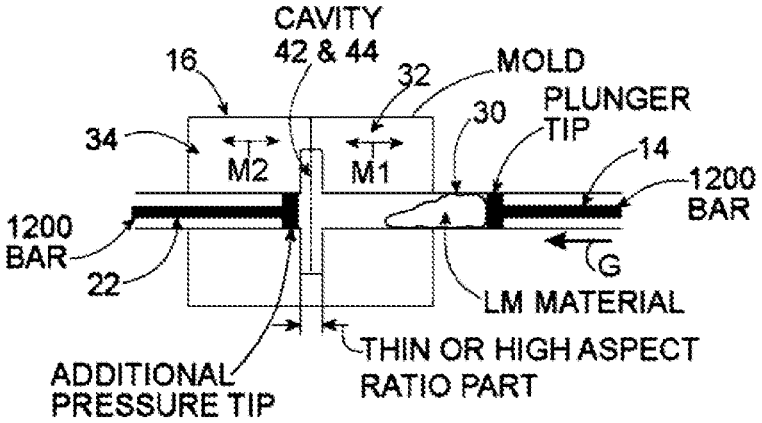
FIG. 7 illustrates a detailed view of using a second plunger rod to assist in injecting molten material into a cavity of a mold being moved therein by a first plunger rod, in accordance with an embodiment.
Figure 8:
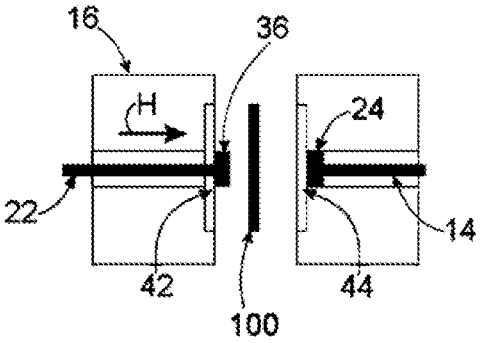
FIG. 8 illustrated a detailed view of using a second plunger rod to eject a molded object from the mold in accordance with an embodiment.

In an embodiment, mold 16 is a vacuum mold that is an enclosed structure configured to regulate vacuum pressure therein when molding materials. For example, as shown in FIGS. 6-8, in an embodiment, vacuum mold 16 has a first mold plate 32 (also referred to as an "A" mold or "A" plate) and a second mold plate 34 (also referred to as a "B" mold or "B" plate) positioned adjacently (respectively) with respect to each other. First plate 32 and second plate 34 each have a mold cavity 42 and 44, respectively, associated therewith for molding melted material therebetween. As shown in the representative cross-sectional view of FIG. 7, the cavities 42 and 44 are configured to mold molten material received therebetween via a transfer sleeve 30. Mold cavities 42 and 44 may include a part cavity for forming and molding a part therein.

Generally, first plate 32 may be connected to transfer sleeve 30. Transfer sleeve 30 (sometimes referred to as a cold sleeve or injection sleeve in the art) may be provided between melt zone 12 and mold 16. Transfer sleeve 30 has an opening that is configured to receive and allow transfer of the molten material therethrough and into mold 16 (using plunger 14). Its opening may be provided in a horizontal direction along the horizontal axis (e.g., X axis). The transfer sleeve need not be a cold chamber. In an embodiment, plunger rods 14 and 22, vessel 20 (e.g., its receiving or melting portion), and opening of the transfer sleeve 30 are provided in-line and on a horizontal axis, such that plunger rod 14 and/or plunger rod 22 can be moved in a horizontal direction through vessel 20 in order to move the molten material into (and subsequently through) the opening of transfer sleeve 30.

First plate 32 can include the inlet of the mold 16 such that molten material can be inserted therein. Molten material is pushed in a horizontal direction through transfer sleeve 30 and into the mold cavity(ies) via the inlet between the first and second plates, 32 and 34. During molding of the material, the at least first and second plates 32 and 34 are configured to substantially eliminate exposure of the material (e.g., amorphous alloy) therebetween to at least oxygen and nitrogen. Specifically, a vacuum is applied such that atmospheric air is substantially eliminated from within the plates 32 and 34 and their cavities 42 and 44. A vacuum pressure is applied to an inside of vacuum mold 16 using at least one vacuum source 38 that is connected via vacuum lines. For example, the vacuum pressure or level on the system can be held between $1\times10^{-1}$ to $1\times10^{4}$ Torr during the melting and subsequent molding cycle. In another embodiment, the vacuum level is maintained between $1\times10^{-2}$ to about $1\times10^{4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr.

Although not shown, an ejector mechanism may be optionally provided to eject molded (amorphous alloy) material (e.g., an object) from the mold cavity between the at least first and second plates 32 and 34. Ejector mechanism can be vacuum sealed relative to the mold and may include an ejector plate with one or more (multiple) ejector pins (not shown) extending in a linear direction therefrom. As generally known in the art, upon movement of an ejector plate, the ejector pins are moved relatively to eject the molded material from the mold cavity of mold 16. The ejection mechanism may be associated with or connected to an actuation mechanism (not shown) that is configured to be actuated in order to eject the molded material or part (e.g., after first and second parts 32 and 34 are moved horizontally and relatively away from each other, after vacuum pressure between the plates 32 and 34 is released). The ejector pins may be configured to push molded material away from cavity 44, for example. In an embodiment, as further described below with reference to FIG. 8, second plunger rod 22 of dual plunger assembly is configured to eject a molded object from mold 16. Second plunger rod 22 may be provided to eject a molded object in addition to or in place of an ejection mechanism.

The illustrated mold 16 is one example of a mold 16 that can be used with injection molding system 10. It should be understood that alternate types of molds may also be employed. For example, any number of additional plates may be provided between and/or adjacent the first and second plates to form the mold. Molds known as "A" series, "B" series, and/or "X" series molds, for example, may be implemented in injection molding system 10. Moreover, in an embodiment, a single plate type mold can be used to mold an object.

Referring back to FIG. 3, the first plunger rod 14 and the second plunger rod 22 of the dual plunger rod assembly are configured to move horizontally along a horizontal axis. For example, as shown by arrow A, first plunger rod 14 is configured to move towards (and through) melt zone 12, and back in an opposite direction. As shown by arrow B, second plunger rod 22 is configured to move towards (and at least adjacent or into) melt zone 12, and back in an opposite direction. Again, each of first plunger rod 24 and second plunger rod 22 can have movable rods (e.g., bases) with plunger tips 24 and 36, respectively, at an end thereof. In an embodiment, the tips 24 and/or 36 of the rods 14 and 22 are configured to transport material. At least the first plunger rod 14 is configured to move molten material towards mold 16. As previously noted, in an embodiment, the first plunger rod 14 and the second plunger rod 22 may be configured to move relative to each other to move molten material from melt zone 12 and into mold 16. Each of the rods may be controlled and moved using a controller and/or an actuation system (e.g., servo-driven drive or a hydraulic drive, not shown) independently and/or jointly. Also, the speed, pressure, or other metrics applied to the material during the process should not be limited. For example, in an embodiment, first and second plunger rods 14 and 22 are configured to apply a pressure between approximately 1000 bar to approximately 1400 bar to the molten material during the molding process. In another embodiment, the applied pressure (on either or both sides of the material) is approximately 1200 bar.

Figure 4:
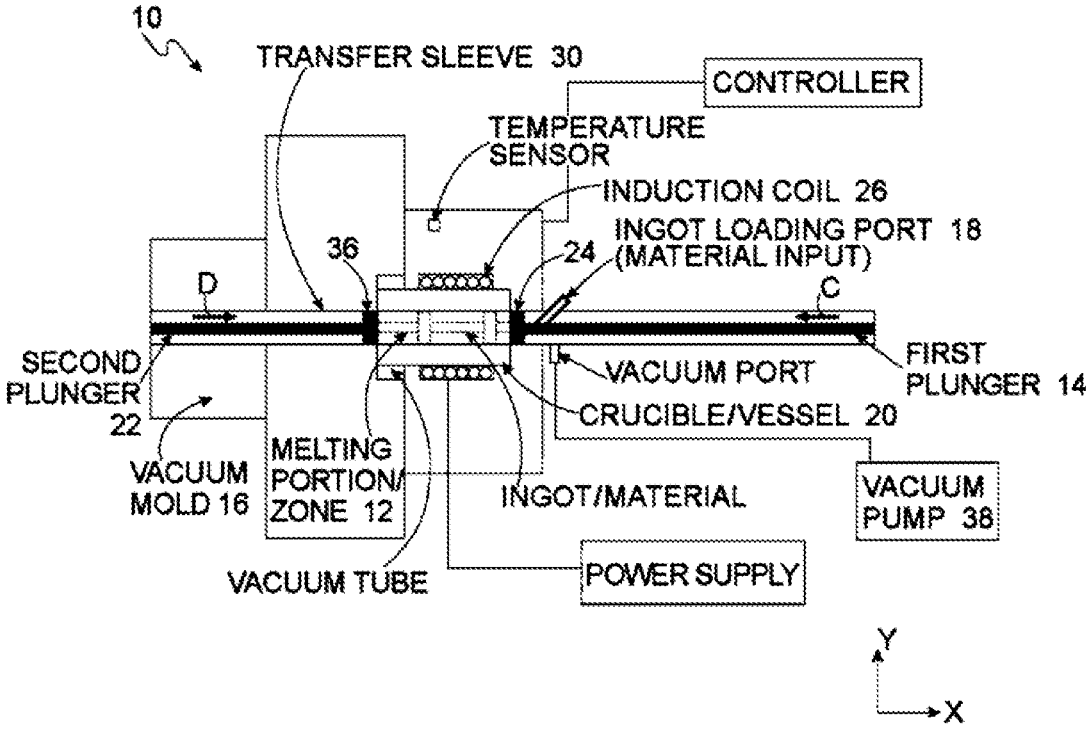
FIGS. 4-6 illustrate movement of the dual plunger rod assembly relative to a melt zone, mold, and each other in the injection system of FIG. 3, in accordance with an embodiment.

To do so, as shown in FIG. 4, first plunger rod 14 is moved along the horizontal axis towards vessel 20 in melt zone 12, as represented by arrow C. Similarly, second plunger rod 22 is moved along the horizontal axis towards vessel 20 in melt zone 12, as represented by arrow D. In an embodiment, at least a portion (e.g., tip) of each of the plunger rods 14 and 22 may be provided adjacent to or within vessel 20, e.g., to contain a material during melting and in molten form. For example, an ingot may be placed within the body of vessel and the first and second plunger rods may be spaced a distance from each other during the melting process. The distance may be predetermined. The tip 24 of first plunger rod 14 and tip 36 of second plunger rod 22 may be spaced relative to or touching the meltable material (ingot) just before the melting process begins. When induction coil 26 is powered to melt the ingot of material, the first plunger rod 14 is typically maintained in its position. In an embodiment, because second plunger rod 22 is spaced at a distance from first plunger rod 14 within the melt zone 12, the second plunger rod 22, therefore, acts as a retaining or containment gate during at least the melting process.

Figure 5:
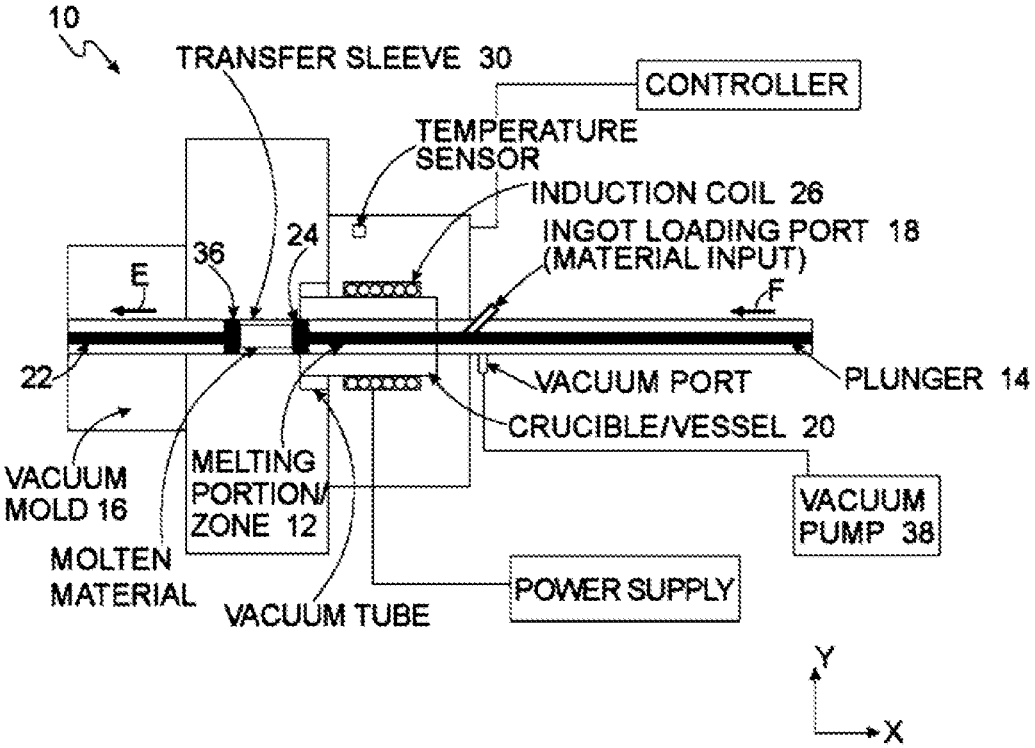

After the material is melted in the vessel 20, the second plunger rod 22 is configured to move in concert with the first plunger rod 14 to encourage laminar flow of the molten material in a horizontal direction towards mold 16. The mold can be positioned adjacent to the melt zone. By containing the molten material between the plunger rods 14 and 22 during movement thereof, it reduces rolling of the molten material (which can reduce mixing of skull material therein) and can assist in maintaining molten material at a higher melt temperature. FIG. 5 illustrates movement of the molten material by first and second plunger rods 14 and 22 towards mold 16, as represented by arrows F and E, respectively. For example, first and second plunger rods 14 and 22 would move in a horizontal direction from the right towards the left, from vessel 20 in melt zone 12, moving and pushing the molten material towards mold 16. The molten material is moved from the melt zone 12/vessel 20 and through optional transfer sleeve 30, while the distance between the tips 24 and 36 is maintained (e.g., to control transport of the molten material as well as prevent any additional air or materials in the space). Accordingly, second plunger rod 22 acts as a molten material retaining gate during part or all of the injection molding process.

Once at mold 16, first plunger rod 14 may be used to force the molten material into a mold 16 for molding into an object, a part or a piece. In instances wherein the meltable material is an alloy, such as an amorphous alloy, the mold 16 is configured to form a molded bulk amorphous alloy object, part, or piece. Mold 16 has an inlet for receiving molten material therethrough. An output of the vessel 20 and an inlet of the mold 16 can be provided in-line and on a horizontal axis such that plunger rods 14 and 22 are moved in a horizontal direction from the vessel 20 to inject molten material into the mold 16 via its inlet.

The dual plunger rod assembly can be used to increase packing pressure of the molten material into the mold to ease filling mold cavities (e.g., of a high aspect ratio part) while doing so without increased or extra force being applied by the plunger rods 14 and/or 22. In an embodiment, the first plunger rod 14 is configured to move in one direction towards the mold along an axis and the second plunger rod 22 is configured to move in a second, opposite direction (to that of first plunger rod) along the axis. For example, as shown in FIG. 6, the second plunger rod 22 is positioned relative to mold 16 and configured to stop and/or apply pressure to molten material on one side 34 of the mold as the first plunger rod 14 is configured to proceed and/or continue (without pause or stopping) to move in the horizontal direction (see arrow F), to push or inject molten material into the cavity (or joined cavities 42 and 44) of mold 16 on an opposite side 32 such that the material is forced therein. More specifically, in one embodiment, the second plunger rod 22 is stopped in a position so that at least its tip 36 is positioned relative to the mold cavity. The second plunger rod 22 can be configured to be maintained in a stopped position such that at least the first plunger rod 14 applies pressure to the molten material when injecting into the mold 16. In another embodiment, the second plunger rod 22 is configured to move in a reverse or opposite direction (e.g., from left to right) such that both of the plungers 14 and 22 are moving relative to or towards each other to apply pressure to the material. In yet another embodiment, pressure can be selectively applied by the second plunger rod 22 in the reverse or opposite horizontal direction, as needed. Thus the second plunger rod 22 can be used to add more pressure to a fill of the mold cavity, and from either or both sides. This added pressure can, for example, apply more pressure on the molten material so that a part that is thinner than usual can be molded.

Accordingly, first and second plunger rods 14 and 22 of the dual plunger assembly as described above are configured to at least move molten material from melt zone 12 and into mold 16 while retaining or containing the molten material therebetween and during movement of the molten material in the horizontal direction.

However, it should be note that the dual plunger assembly may be configured for operation in a different manner. FIG. 7 illustrates an alternate embodiment that may be implemented in the described injection system 10, wherein at least the first plunger rod 14 is configured to move molten material from vessel 20 and into mold 16 (in a horizontal direction, e.g., see arrow G). Although the second plunger rod 22 can be used to transport the molten material from the melt zone 12, in another embodiment, the second plunger rod 22 may be configured to be moved and placed in position adjacent or in mold 16 before injection of molten material therein by the first plunger rod 14. Accordingly, second plunger rod 22 is provided adjacent a mold cavity (or cavities) within mold 16 and used to increase packing pressure without extra force and to ease filling of a high aspect ratio cavity, such as described in more detail above with reference to FIG. 6, but second plunger rod 22 need not necessarily be used or limited to continuously transporting molten material from the melt zone 12 towards mold 16.

In addition to transporting molten material, in an embodiment, either one of the first and second plunger rods 14 and 22 of dual plunger rod assembly may be used as an ejection mechanism to eject a molded object or part from mold 16 when the molding process is complete. For example, as indicated by arrows M1 and M2 in FIG. 7, first mold plate 32 and second mold plate 34 can move relative to, i.e., towards and away from each other. During molding, for example, plates 32 and 34 are adjacent each other and under vacuum pressure. Once molding is complete, vacuum pressure is released and the molded object can be removed or ejected from the mold. Typically, for example, an ejection mechanism (e.g., ejection plate and/or ejection pins) can be used to eject the molded part, e.g., from second side 34 of the mold. In accordance with an embodiment illustrated in FIG. 8, the second plunger rod 22 is configured to move in a horizontal direction (e.g., from left to right, as indicated by arrow H) to eject a molded object 100 from second mold plate 34. At least its tip 36 is used to apply pressure to the molded object 100 so that it is removed from within the mold 16. The second plunger rod 22 (or first plunger rod 14) can be used in addition to an ejection mechanism or as an alternative option to an ejection mechanism. The first plunger rod 14 may be provided in a stationary position relative to the mold 16.

Alternatively, in another embodiment, should the molded object be maintained in the first mold plate 32 when the plates are separated, or should only a single mold be employed for mold 16, the first plunger rod 14 is configured to move in a horizontal direction (e.g., from right to left) to eject the molded object from first mold plate 32. In some embodiments, the first plunger rod 14 can be used in addition or alternatively to an ejection mechanism.

Generally, the injection molding system 10 may be operated in the following manner: Meltable material (e.g., amorphous alloy or BMG) is loaded into a feed mechanism (e.g., loading port 18), inserted and received into the melt zone 12 into the vessel 20 (surrounded by the induction coil 26). The injection molding machine "nozzle" stroke or plunger 14 can be used to move the material, as needed, into the melting portion of the vessel 20. The system can be placed under vacuum using vacuum source 38. The first plunger rod 14 and the second plunger rod 26 are moved into melt zone 12 relative to each other and to the material to be melted and spaced at a distance suitable to contain the material. The material is then heated through the induction process by heating induction coil 26. Once the temperature is achieved and maintained to melt the meltable material, the heating using induction coil 26 can be stopped and the machine will then begin the injection of the molten material from vessel 20, through transfer sleeve 30, and into vacuum mold 16 by moving in a horizontal direction (from right to left) along the horizontal axis. The movement of the molten material is controlled using both plungers 14 and 22 (e.g., which can be activated using a servo-driven drive or a hydraulic drive). The mold 16 is configured to receive molten material through an inlet and configured to mold the molten material under vacuum. That is, the molten material is injected into a cavity between the at least first and second plates to mold the part in the mold 16. The second plunger rod 22 can be positioned on second side 34 of the mold to maintain pressure within the mold as the first plunger rod 14 continues to move or push molten material into its cavity. Once the mold cavity has begun to fill, vacuum pressure (via the vacuum lines and vacuum source 38) can be held at a given pressure to "pack" the molten material into the remaining void regions within the mold cavity and mold the material. After the molding process (e.g., approximately 10 to 15 seconds), the vacuum pressure applied to the mold 16 is released. Mold 16 is then opened to relieve pressure and to expose the part to the atmosphere. Second plunger rod 22 (and/or an ejector mechanism) can be actuated in a horizontal and linear direction (e.g., towards the right) to eject the solidified, molded object from between the at least first and second plates of mold 16. Thereafter, the process can begin again. Mold 16 can then be closed by moving at least the at least first and second plates relative to and towards each other such that the first and second plates are adjacent each other. The melt zone 12 and mold 16 is evacuated via the vacuum source once the plungers 14 and 22 have moved back into a load position and possibly melting position, in order to melt more received meltable material and mold another part.

Accordingly, the herein disclosed embodiments illustrate an exemplary injection system that has its melting system in-line with a dual plunger rod assembly configured for movement along a horizontal axis during the melting and molding process. The system and/or its parts do not need to be limited to being positioned for movement of material in a horizontal direction, however. The dual plunger rod assembly can be configured to move along any longitudinal axis in a longitudinal direction. For example, in another embodiment, the dual plunger rod assembly and melt zone can be provided along a vertical axis (e.g., Y-axis, not shown), so that plunger rods 14 and 22 and material are moved from melt zone 12 and into mold 16 in a vertical direction.

Accordingly, the dual plunger rod assembly described herein provides a number of employable features to the herein described injection molding system 10. For example, it uses two plungers to retain material therebetween and control transport thereof. Also, with regards to systems provided in line and with at least a melt zone and mold on a horizontal axis, the speed of injection of the molten material into mold 16 can be controlled by the movement of plungers 14 and 22, particularly as compared to pour systems that tend to pour material quickly into a mold, and conventional die casting systems. The disclosed dual plunger system allows for more uniform cooling of the part, and at faster rate than that of a single plunger system.

Further, because the second plunger rod 22 acts a retention or containment gate (e.g., during molding), any addition of another gate is unnecessary. This reduces the length and amount of space that may be needed in prior or known systems. Moreover, this can also reduce the length of the transfer sleeve 30 (if provided). Accordingly, by having a dual plunger adjacent sleeves such as transfer sleeve 30 and/or other parts in the machine can be shortened, which in turn allows for the molten material to be pushed more quickly into the mold by shortening the distance it needs to move from the melt zone before arriving at the mold input. It also means that the molten material will arrive at the mold at a higher temperature, and that during molding the material is less subject to defects based on the quenching rate of the mold. In particular, when using materials that go amorphous, maintaining a higher temperature and reducing the rate at which such molten material cools as it travels towards the mold improves its glass formability (before quenching quickly in the mold). By keeping the molten material contained in a space or distance between the two plunger rods 14 and 22 as they move in concert towards the mold, the surface area can be can kept relatively the same, as well as the temperature.

Moreover, using the dual plunger rod assembly may aid in reducing surface defects in molded objects by forcing a more laminar flow of material. Typically, when molten material is able to roll, at least some of the skull material (e.g., from the bottom) may end up within the molten material. Thus, some unwanted crystallized material can be molded and end up in the final part. However, if molten material is moved in a relatively linear manner, as provided by the plungers 14 and 22, rolling of skull material into the melt can be reduced and/or avoided. The dual plunger rod assembly disclosed herein can also reduce defects by filling smaller features in the molds by keep pressure on the melt at all times, and filling larger parts by allowing for an increase in the velocity of the flow (since it is controlled by both plungers). It also traps and/or prevents air or porosity within the distance or space between the two plungers.

In addition to the features described herein, it should be understood that the dimensions and materials used for the plunger rods 14 and 22 should not be limited. Any number of materials can be used to form the rods and/or the tips 24 and 36 thereof. Different materials may be used to form different parts. The tips 24 and 36 may be formed of one or more materials. In an embodiment, at least the tips of both plunger rods 14 and 22 have a similar diameter. In another embodiment, plunger rod 14 and plunger rod 22 have different diameters. In another embodiment, one or more of the rods 14 and/or 22 may include a telescopic body. In yet another embodiment, one plunger may contain another plunger therein.

Although not described in great detail, the disclosed injection system may include additional parts including, but not limited to, one or more sensors, flow meters, etc. (e.g., to monitor temperature, cooling water flow, etc.), and/or one or more controllers. Also, seals can be provided with or adjacent any of number of the parts to assist during melting and formation of a part of the molten material when under vacuum pressure, by substantially limiting or eliminating substantial exposure or leakage of air. For example, the seals may be in the form of an O-ring. A seal is defined as a device that can be made of any material and that stops movement of material (such as air) between parts which it seals. The injection system may implement an automatic or semi-automatic process for inserting meltable material therein, applying a vacuum, heating, injecting, and molding the material to form a part.

FIG. 9 through FIG. 14 depict an exemplary injection molding apparatus at various stages for forming a molded object in accordance with various embodiments of the present teachings. Although the apparatus illustrated in the Figures is an apparatus aligned along a horizontal axis, it should be understood and within the scope of this disclosure that similar features may be provided on a vertically positioned injection molding system (e.g., wherein there is vertical movement of material into a mold), and that herein disclosed features can be applied to a vertical apparatus or system. Additionally, it should be understood that although not explicitly described, any of the above described features in the embodiments of FIGS. 3 through 8 can be included in addition to and/or as alternative to features in any of the embodiments of FIGS. 9-14, and vice versa.

The exemplary apparatus may include a mold 110, a constraining plunger 120, a transfer sleeve 130, an injection plunger 140, and/or a melt zone 150. The melt zone 150 may include, e.g., a temperature regulated vessel 152, and/or a heating component 154.

The mold 110 can include, for example, a first mold part 110*a* and a second mold part 110*b* positioned adjacently (respectively) with respect to each other. The first mold part 110*a* and the second mold part 110*b* can each have a cavity and can form an enclosed structure to provide the mold 110 with mold cavity or cavities 112. Molten materials can be received in the mold cavity 112 formed between the mold parts 110*a/b* via a transfer sleeve 130. In an embodiment, the mold 110 is a vacuum mold configured to regulate vacuum pressure therein when molding materials. For example, one mold part (e.g., part 110*b*) can include an inlet such that molten material can be injected therein. Molten material is pushed in a horizontal direction through transfer sleeve 130 and into the mold cavity or cavities 112 via the inlet. During molding of the material, the mold parts 110*a/b* are configured to substantially eliminate exposure of the material (e.g., amorphous alloy) therebetween to any reactive agents such as oxygen and/or nitrogen. In one embodiment, a vacuum is applied such that atmospheric air is substantially eliminated from within the cavity or cavities 112. A vacuum pressure is applied to an inside of vacuum mold 110 using at least one vacuum source (not shown) that is connected via vacuum lines. For example, the vacuum pressure or level on the system can be held between $1\times10^{-1}$ to $1\times10^{4}$ Torr during the melting and subsequent molding cycle. In another embodiment, the vacuum level is maintained between $1\times10^{-2}$ to about $1\times10^{4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr.

Figure 9:
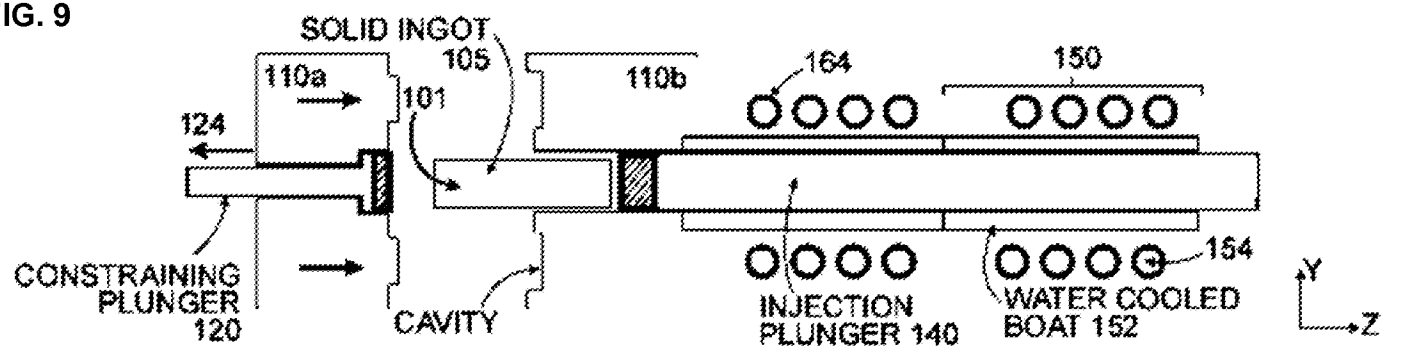
FIGS. 9-14 illustrate an exemplary injection molding apparatus at various stages during an injection molding process in accordance with embodiments herein.

The constraining plunger 120 can be configured within or through one mold part 110*a* , wherein the mold part 110*a* can have a hard stop mechanism 125 associated with the constraining plunger 120. The hard stop mechanism 125 can be, e.g., a shoulder structure for the constraining plunger 120, to prevent the constraining plunger 120 from keeping moving further in one direction, such as direction 124 as shown in FIG. 9, while the constraining plunger 120 can move freely in a direction opposite to direction 124. For example, the constraining plunger 120 can move in the direction 124 until it reaches the hard stop mechanism 125, where the constraining plunger 120 cannot move further in the direction 124. That is, due to the hard stop mechanism 125, the constraining plunger 120 does not have to be capable to applying full packing pressure. In embodiments, the hard stop mechanism 125 can allow the constraining plunger 120 to be configured without affecting the shape, size, and/or surface properties of the mold cavity 112. In some cases, the hard stop mechanism 125 can allow the constraining plunger 120 together with the mold part 110*a*, and the mold part 110*b* to provide desired mold cavity 112 for molding the molten material. The constraining plunger 120 can be formed of the same or different materials and/or surfaces as compared with the mold materials.

The constraining plunger 120 can be the same or different as compared with the injection plunger 140. The plungers 120/140 can be configured to constrain the molten material (after heating/melting) there-between and transfer or move the molten material from the melt zone 150, by moving substantially through the vessel 152, and through the transfer sleeve 130, and into the mold 110. In embodiments, the movement of the injection plunger 140 and the constraining plunger 120 can be substantially synchronized at the same (although may be different) moving rate, when molten material is constrained there-between and moved horizontally along a horizontal axis. For example, as shown by arrow 144, the injection plunger 140 can be configured to move towards (and through) melt zone 150, and back in an opposite direction. As shown by arrow 124, the constraining plunger 120 can be configured to move towards (and at least adjacent or into) melt zone 150, and back in an opposite direction until it reaches the hard stop mechanism 125. Each of the plungers 120/140 can have movable rods (e.g., bases) with plunger tips 128, 148, respectively, at an end thereof. In an embodiment, the tips 128 and/or 148 of the plungers 120/140 are configured to transport material such that the molten material is constrained between the plungers 120/140 and moved towards the mold 110. In an embodiment, either or both plungers may include temperature regulating lines, such as cooling lines as disclosed herein. In embodiments, the temperature regulating lines for the plungers (and/or their tips) can use the same or different temperature regulating lines as for the vessel 152 for receiving and melting materials therein. For example, lines (not shown) may be provided in each of the plungers and into tips 128 and/or 148. Such an addition of cooling liquid may assist in keeping plunger tips 128/148 cool while transporting material, preventing excessive heating and/or melting of the tips, for example. In an embodiment, both of the plungers are water cooled (or forced cooled) to act as a quenching mechanism. In one embodiment, both plungers may be provided at or cooled to a similar temperature. In another embodiment, one plunger (and/or its tip) may have a higher temperature than the other plunger (and/or its tip). In another embodiment, one plunger (and/or its tip) may be at a temperature higher than Tg of the material/alloy. In yet another embodiment, one plunger may be at a temperature within the super cooled region of the casting alloy. In certain embodiments, each of the plunger tips 128 and 148 can be independently water cooled and/or oil heated to provide desired tip temperatures for each of the tips 128/148 for transferring the molten material. In embodiments, the cooling and/or heating lines may not be used.

In embodiments, each of the plungers may be controlled and moved using a controller and/or an actuation system (e.g., servo-driven drive or a hydraulic drive, not shown) independently and/or jointly. Also, the speed, pressure, or other metrics applied to the molten material during the process by each of the injection plunger 140 and the constraining plunger 120 can be controlled without limitation. In addition, the degree of synchronization, the spacing, etc., between the injection plunger 140 and the constraining plunger 120 can be controlled without limitation. As such, a surface area to volume ratio of the molten material during the movement through the transfer sleeve can be controlled, for example, can be reduced as desired. In embodiments, for certain amount of the molten material, the surface area to volume ratio of the molten material can be minimized during the movement. Heat transfer or heat loss to the neighboring parts or environment can thus be reduced or minimized.

In another embodiment, the heat transfer or heat loss can be further reduced or minimized by controlling a distance between the mold 110 and the melt zone 150 that the molten material needs to travel through. For example, the melt zone can be configured having a minimal distance to the opening of mold. In yet another embodiment, a secondary heating component 164 such as any suitable heating source can be positioned to be associated with the transfer sleeve 130 between the mold 110 and the melt zone 150 to provide sufficient heat (or cooling in sometimes) to the molten material during its moving or transferring such that the molten material can be molded at a desired cooling rate in the mold 110 to form a molded object. The secondary heating component 164 can be formed of the same or different materials (along with their configurations), as compared with the heating component 154. In one embodiment, the secondary heating component 164 can be powered with a minimal power to at least keep the molten material at a desired temperature range (e.g., at a critical high temperature or greater) when travelling in the transfer sleeve. In this case, even if there is heat loss for any reason, the secondary heating component 164 can at least offset this heat loss.

In embodiments, each of the injection plunger 140 and the constraining plunger 120 can be configured to apply a pressure between approximately 1000 bar to approximately 1400 bar to the molten material during the molding process. In another embodiment, the applied pressure (on either or both sides of the material) is approximately 1200 bar.

The transfer sleeve 130 can be connected to the mold 110. Transfer sleeve 130 (sometimes referred to as a shot sleeve, cold sleeve or injection sleeve in the art) may be provided between the mold 110 and the melt zone 150. Transfer sleeve 130 may have an opening that is configured to receive and allow transfer of the molten material there-through and into mold 110 (e.g., using one or more plungers 120/140). Its opening may be provided in a horizontal direction along the horizontal axis (e.g., X axis). The transfer sleeve need not be a cold chamber. In an embodiment, plungers 120/140, vessel 152 (e.g., its receiving or melting portion), and opening of the transfer sleeve 130 can be provided in-line and on a horizontal axis, such that the plunger(s) can be moved in a horizontal direction through vessel 152 in order to move the molten material into (and subsequently through) the opening of transfer sleeve 130.

Melt zone 150 includes a melting mechanism configured to receive and hold materials such as the alloy feedstock as it is heated to a molten state. The melting mechanism may be in the form of a vessel 152 configured to receive and melt the materials (see 105) therein. A vessel as used throughout this disclosure is a container made of a material employed for heating substances to high temperatures. For example, in an embodiment, the vessel may be a crucible, such as a boat style crucible, or a skull crucible. In an embodiment, vessel 152 can be a cold hearth melting device that is configured to be utilized to melt materials while under a vacuum. In one embodiment, the vessel 152 can extend in a longitudinal and horizontal direction, such that the molten material can be removed horizontally therefrom using the injection plunger 140 and/or the constraining plunger 120.

In one embodiment, the vessel 152 can be a temperature regulated vessel having a surface temperature regulated during melting. Such a vessel may include one or more temperature regulating lines configured to flow a fluid (e.g., water, oil, air, or other fluid) therein for regulating a temperature of the material received in the vessel (e.g., to force cool the vessel). Such a forced-cool crucible can also be provided on the same axis as the plungers. The cooling line(s) assist in preventing excessive heating and melting of the body of the vessel 152 itself. In an embodiment, the vessel 152 may be water cooled (or forced cooled). Any of the herein cooling line(s) may be connected to a cooling system (not shown) configured to induce flow of a fluid in the vessel. The cooling line(s) may include one or more inlets and outlets for the cooling fluid to flow there-through. The inlets and outlets of the cooling lines may be configured in any number of ways and are not meant to be limited. The number, positioning and/or direction of the cooling line(s) should not be limited. The cooling fluid may be configured to flow through the cooling line(s) during melting of the materials in the melt zone 150, when heating component such as induction source 154 is powered, and/or during transport of the molten material from the melt zone 150.

Vessel 152 may have an inlet for inputting material (e.g., feedstock) into a receiving or melting portion of its body. Vessel 152 can include any number of shapes or configurations. Vessel 152 may receive material (e.g., in the form of an ingot (solid state), a semi-solid state, a slurry that is preheated, powder, pellets, etc.) in its melting portion using one or more devices of the disclosed injection apparatus for delivery (e.g., plunger(s)). The body of the vessel has a length and can extend in a longitudinal and horizontal direction, such that molten material is removed horizontally therefrom using plunger(s) 120/140, for example. Its body may be formed from any number of materials (e.g., copper, silver), include one or more coatings, and/or configurations or designs. The body of vessel may be configured to receive at least the injection plunger 140 (or both plungers 120/140) therein and there-through in a horizontal direction to move the molten material. In embodiments, the melting mechanism is on the same axis as the plungers 120/140, and the body can be configured and/or sized to receive at least part of the plunger(s). Thus, at least the injection plunger 140 can be configured to move molten material (after heating/melting) from the vessel 152 by moving substantially through the vessel 152, and into mold 110 (e.g., as shown and described with reference to FIGS. 10-13).

A heating component can be used to heat and melt, e.g., the alloy feedstock. At least a melting portion of the vessel 152, if not substantially the entire body itself, is configured to be heated such that the material received therein is melted. Heating is accomplished using, for example, an induction source 154 positioned within the melt zone 150. In an embodiment, induction source can be positioned adjacent vessel 152. For example, induction source may be in the form of a coil positioned in a helical pattern substantially around a length of the vessel body. Accordingly, vessel 152 is configured to inductively melt the material (e.g., an inserted ingot) within its melting portion by supplying power to induction source/coil 154, using a power supply or source (not shown). Induction coil 154 can be configured to heat up and melt any material that is contained by vessel 152 without melting and wetting vessel 152. Induction coil 154 can emit radiofrequency (RF) waves towards vessel. As shown, the coil 154 surrounding vessel 152 may be configured to be positioned in a horizontal direction along a horizontal axis (e.g., X axis).

Referring back to FIG. 9, in this example, the alloy feedstock 105, in a solid ingot form, can be muzzle loaded at arrow 101 from the mold side of the apparatus depicted in FIGS. 9-14 into the transfer sleeve 130, e.g., through an opened mold having the first and second mold parts 110*a/b* spaced apart for loading. Although the starting material, e.g., the alloy feedstock 105, as depicted herein is in the form of an ingot (solid state), one of ordinary skill in the art would know that a semi-solid state, a slurry that is preheated, powder, pellets, etc. can be used as the starting feedstock. That is, in certain embodiments, instead of having to open a separate compartment (e.g., a conventional loading port) behind the induction coils, for example, which have positional complexities, the alloy feedstock can be loaded in front of the tool (or the mold 110) and be shoved into the transfer sleeve in a horizontal direction with a constraining plunger.

Figure 10:
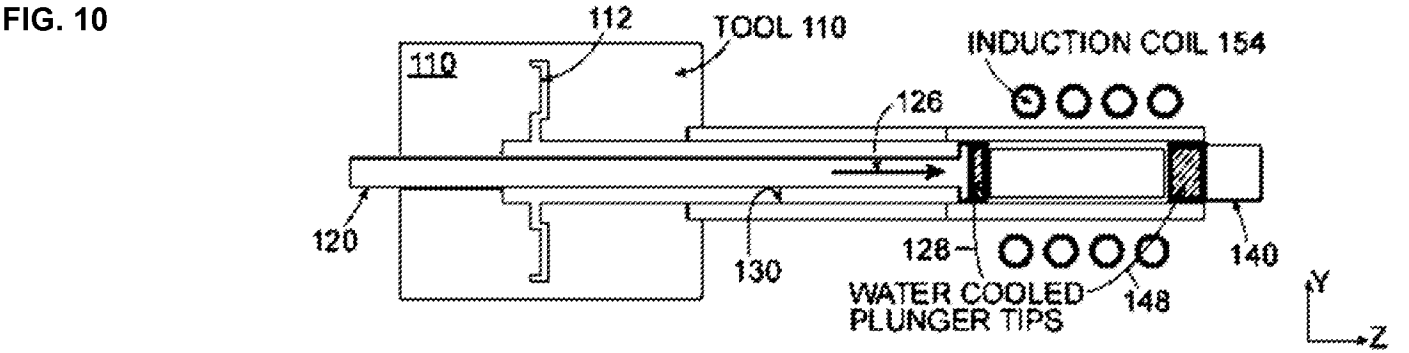

In FIG. 10, by using the constraining plunger 120, the alloy feedstock 105 can be pushed (e.g., at a direction 126) into the melt zone 150 through the transfer sleeve 130 until the alloy feedstock 105 is received by the vessel 152 in the melt zone 150.

Figure 11:
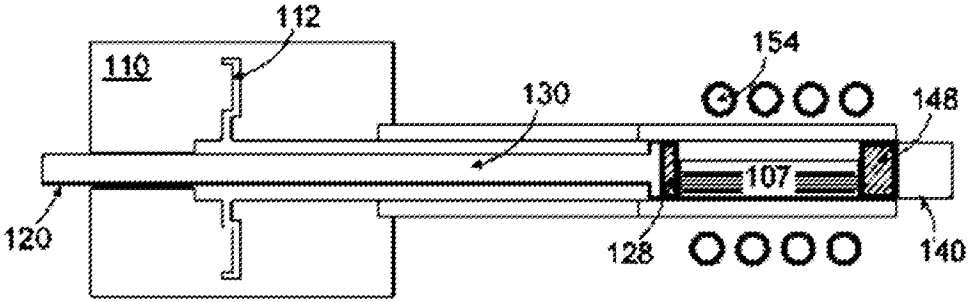

In FIG. 11, the alloy feedstock 105 may be melted in the vessel 152 at the melt zone 150 to form molten material 107. The molten material 107 can be constrained by the constraining plunger 120 at one end adjacent to the mold 110 and by the injection plunger 140 at the other end distant from the mold 110. The molten material 107 can be held in shape by the constraining plunger 120, when melting at the melt zone 150 and/or transferring through the transfer sleeve 130 into the mold 110, as depicted in FIGS. 11-12.

Figure 12:
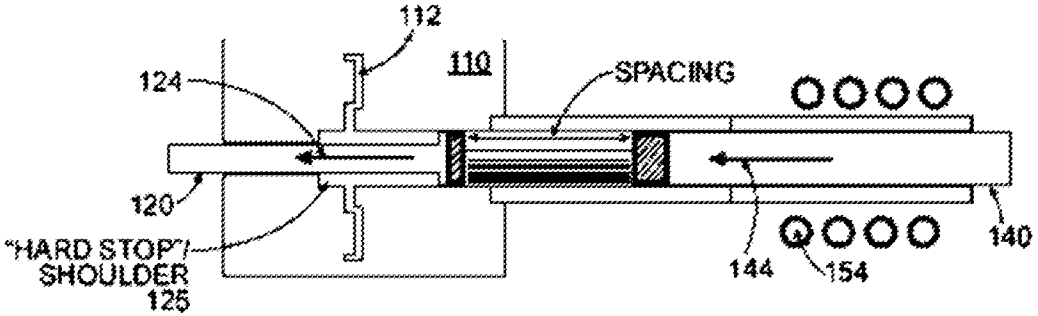

In FIG. 12, the molten material 107 constrained by the constraining plunger 120 and the injection plunger 140 can be moved or transferred through the transfer sleeve 130. The movement of the constrained molten material 107 can be controlled by controlling e.g., speed, pressure, spacing, synchronization degree of the plungers 120/140, the amount of the molten material 107, the traveling distance in the transfer sleeve 130, the surface temperature of the transfer sleeve 130, etc. In this manner, the surface area to volume ratio and/or the geometry of the molten material when transferred and/or injected can be controlled (e.g., reduced or minimized), such that heat transfer or heat loss is minimized during moving or transferring through the transfer sleeve 130 into the mold 110. For example, the movement of the constraining plunger 120 and the injection plunger 140 can be substantially synchronized (e.g., moving at the same rate) and/or the spacing therebetween can vary as desired when moving the constrained molten material 107, such that the molten material has an optimum surface areas for volume motion to minimize heat transfer or heat loss.

Figure 13:
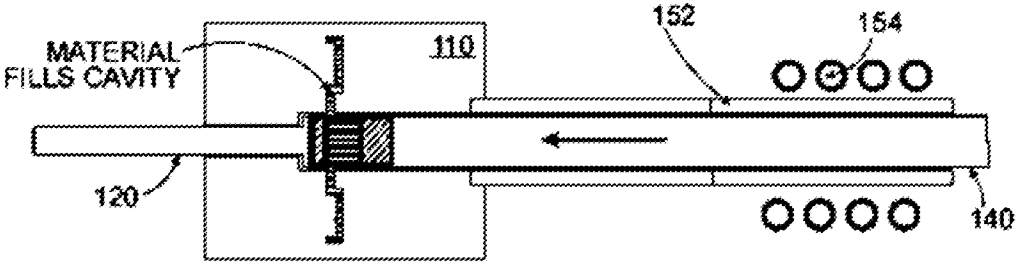

In FIG. 13, when the constrained molten material 107 is transferred into the mold cavity 112, the constraining plunger 120 may be moved to connect to the hard stop mechanism 125 and will not move at direction 124. The molten material 107 can then be molded in the mold cavity, e.g., by solidifying at a cooling rate. In embodiments, the molten material can be molded to form a BMG object at the cooling rate as discussed above.

Figure 14:
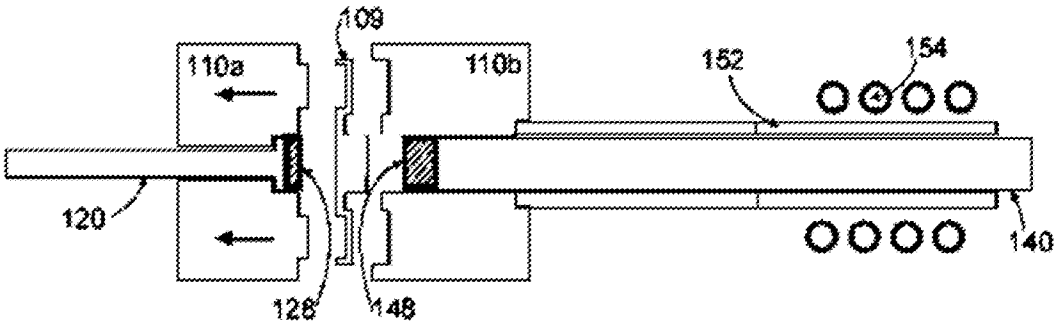

In FIG. 14, the molded object 109 can be ejected from the mold parts 110*a/b*, e.g., by an ejector mechanism (not shown) as known in the art. The ejector mechanism may be optionally provided to eject molded (amorphous alloy) object 109 from the mold cavity between the first and second mold parts 110*a/b*. Ejector mechanism can be vacuum sealed relative to the mold and may include an ejector plate with one or more (multiple) ejector pins (not shown) extending in a linear direction therefrom. As generally known in the art, upon movement of an ejector plate, the ejector pins are moved relatively to eject the molded material from the mold cavity of mold 110. The ejection mechanism may be associated with or connected to an actuation mechanism (not shown) that is configured to be actuated in order to eject the molded material or object (e.g., after first and second mold parts 110*a/b* are moved horizontally and relatively away from each other, after vacuum pressure between the mold parts 110*a/b* is released). The ejector pins may be configured to push molded material away from cavity 112, for example. In an embodiment, the constraining plunger 120 can be configured to eject the molded object 109 from the mold 110, for example, in addition to or in place of an known ejection mechanism.

As previously noted, apparatus such as injection molding apparatus shown in FIGS. 9-14 that are used to mold materials may implement a vacuum when forcing molten material into a mold (or a die cavity). Apparatus shown in FIGS. 9-14 can further includes at least one vacuum source (not shown) or pump that is configured to apply vacuum pressure to at least melt zone 150 and mold 110. The vacuum pressure may be applied to at least the parts of the injection molding apparatus used to melt, move or transfer, and mold the material therein. For example, the vessel 152, the transfer sleeve 130, the constraining plunger 120, and/or the injection plunger 140, may all be under vacuum pressure and/or enclosed in a vacuum chamber during the melting and injection process.

The methods, techniques, and devices illustrated herein are not intended to be limited to the illustrated embodiments. In embodiments, the alloy feedstock may include any types of alloys. In one embodiment, multiple molds can be used in parallel.

Also, the material to be molded (and/or melted) using any of the embodiments of the injection system as disclosed herein may include any number of materials and should not be limited. In one embodiment, the material to be molded is an amorphous alloy, as described in detail above.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A method comprising:

pushing, with a constraining plunger an amorphous alloy feedstock through a transfer sleeve and into a melt zone between an injection plunger and the constraining plunger;

melting the amorphous alloy feedstock in the melt zone to form a molten material;

constraining the molten material between the injection plunger and the constraining plunger during the melting operation;

moving the molten material into the mold; and molding the molten material into a bulk metallic glass part.

2. The method of claim 1, further comprising controlling movement of the constraining plunger in a retraction direction using a hard stop mechanism.

3. The method of claim 1, wherein the operation of constraining the molten material between the injection plunger and the constraining plunger during the melting operation comprises constraining a ratio of a surface area to a volume of the molten material when the molten material is moved into the mold.

4. The method of claim 1, further comprising:

applying pressure, using the constraining plunger, to a portion of the molten material adjacent the constraining plunger;

pushing, with the injection plunger, a portion of the molten material adjacent the injection plunger.

5. The method of claim 1, wherein the operation of moving the molten material into the mold comprises moving the constraining plunger and the injection plunger in a same direction.

6. The method of claim 1, wherein the operation of melting the amorphous alloy feedstock comprises activating an induction source associated with the melt zone.

7. The method of claim 1, further comprising ejecting the bulk metallic glass part from the mold using the constraining plunger.

8. The method of claim 1, wherein the operation of moving the molten material into the mold further comprises pushing the molten material through a transfer sleeve between the melt zone and the mold.

9. The method of claim 1, further comprising applying a vacuum to one or more of the mold and the melt zone.

10. A method of forming a bulk metallic glass part, comprising:

loading an alloy feedstock into a transfer sleeve through an opening in a first mold part; and pushing the alloy feedstock into a melt zone using a constraining plunger;

melting the alloy feedstock in the melt zone to produce a molten material; and moving the molten material from the melt zone, through the transfer sleeve, and into a mold while constraining the molten material between the constraining plunger and an injection plunger.

11. The method of claim 10, further comprising controlling movement of the constraining plunger in a retraction direction using a hard stop mechanism of a second mold part.

12. The method of claim 10, further comprising controlling the constraining plunger and the injection plunger such that the molten material has a minimum surface area to volume ratio when moving.

13. The method of claim 10, further comprising:

applying pressure, using the constraining plunger, to a portion of the molten material adjacent the constraining plunger; and pushing, using the injection plunger, a portion of the molten material adjacent the injection plunger.

14. The method of claim 10, further comprising, during the operation of moving the molten material from the melt zone, synchronizing movement of the constraining plunger and the injection plunger along a horizontal axis.

15. The method of claim 10, further comprising forming a molded bulk amorphous alloy object in the mold.

16. The method of claim 10, further comprising, during the operation of moving the molten material from the melt zone, through the transfer chamber, and into the mold, activating an induction coil associated with the transfer sleeve to maintain a temperature of the molten material within a temperature range.

17. The method of claim 10, further comprising:

molding the molten material to form a molded object; and electing the molded object from the mold using the constraining plunger.

18. A method, comprising:

introducing an amorphous alloy feedstock into a transfer sleeve via an opening in a mold;

pushing the amorphous alloy feedstock into a melt zone using a first plunger;

heating the amorphous alloy feedstock to form an injectable amorphous material;

constraining the injectable amorphous material between the first plunger and a second plunger during at least the heating operation;

retracting the first plunger to form at least part of a surface of a mold cavity;

pushing the injectable amorphous material into the mold cavity using the second plunger; and cooling the injectable amorphous material to form a bulk metallic glass part.

19. The method of claim 18, further comprising ejecting the bulk metallic glass part from the mold cavity using the first plunger.

20. The method of claim 18, further comprising ejecting the bulk metallic glass part from the mold cavity using an ejection pin.

21. The method of claim 18, wherein the operation of retracting the first plunger to form the at least part of the surface of the mold cavity comprises retracting the first plunger against a hard stop mechanism of a mold part.

22. The method of claim 18, wherein:

the mold cavity is a first mold cavity of a first mold part; and the method further comprises, prior to pushing the amorphous alloy feedstock into the melt zone, passing the amorphous alloy feedstock through an opening in a second mold cavity of a second mold part.

23. The method of claim 18, further comprising applying a molding pressure to the injectable amorphous material using the second plunger.

24. The method of claim 18, wherein:

the operations of retracting the first plunger to form the at least part of the surface of the mold cavity and pushing the injectable amorphous material into the mold cavity are performed substantially simultaneously; and the method further comprises, during the operations of retracting the first plunger to form the at least part of the surface of the mold cavity and pushing the injectable amorphous material into the mold cavity, contacting the injectable amorphous alloy with both the first plunger and the second plunger.

* * * * *